US005628114A

United States Patent [19]

Stern

[11] Patent Number: 5,628,114

[45] Date of Patent: May 13, 1997

[54] SCREEN FRAME AND METHOD OF MANUFACTURE THEREOF

[76] Inventor: Mel Stern, 14400 S. San Pedro St., Gardena, Calif. 90248

[21] Appl. No.: 494,810

[22] Filed: Jun. 26, 1995

[51] Int. Cl.[6] ..... B21D 35/00

[52] U.S. Cl. ..... 29/897.312; 29/430; 29/432.2; 29/438; 29/558; 72/379.2

[58] Field of Search ..... 29/897.312, 429, 29/430, 432, 432.1, 432.2, 437, 438, 505, 527.1, 527.4, 557, 558, 897.31; 72/379.2, 404

[56] References Cited

U.S. PATENT DOCUMENTS

| | | | |
|---|---|---|---|
| 3,367,164 | 2/1968 | Franks et al. | 72/379.2 |
| 3,571,909 | 3/1971 | Stern | 29/509 |
| 3,879,894 | 4/1975 | Anderson | 49/420 |
| 4,078,288 | 3/1978 | Abramson | 29/897.312 |
| 4,112,622 | 9/1978 | Stewart | 49/421 |
| 4,360,959 | 11/1982 | Johannesen | 72/379.2 |
| 4,462,237 | 7/1984 | Käuferle | 72/324 |
| 4,503,640 | 3/1985 | Stern | 49/425 |
| 4,562,677 | 1/1986 | Hrabák | 52/211 |
| 5,018,263 | 5/1991 | Stern | 29/469.5 |
| 5,277,357 | 1/1994 | Miyamoto et al. | 72/379.2 |
| 5,295,292 | 3/1994 | Leopold | 29/417 |
| 5,361,476 | 11/1994 | Leopold | 29/417 |
| 5,501,013 | 3/1996 | Misera et al. | 29/897.312 |
| 5,511,405 | 4/1996 | Kikuchi | 72/404 |

*Primary Examiner*—Larry I. Schwartz
*Assistant Examiner*—Marc W. Butler
*Attorney, Agent, or Firm*—Charles H. Thomas

[57] ABSTRACT

An improved method of hollow metal screen frame production allows screen frames to be produced far more quickly than has heretofore been possible. Each of the cutting dies in the production line is provided with an accelerator that moves the prenotching dies at the speed of the flat sheet metal strip used to form the screen frames. As a consequence, the sheet metal strip can be fed continuously without stopping for punching of corner openings. Also, the configuration of the corners are improved by die cutting locking tabs and corresponding locking tab openings in adjacent members. Once the screen frame has been longitudinally bent at its corners to form the jamb, head, and sill members, the locking tabs of one member project through locking tab openings defined in an adjacent member. The locking tabs are simultaneously bent over using forming dies arranged in pairs with the forming dies within each pair acting in opposition to each other. The forming dies thereby concurrently, inelastically deform the locking tabs so that they cannot be withdrawn through the locking tab openings. The corners of the frame are thereby held in right angle alignment.

13 Claims, 6 Drawing Sheets

SCREEN FRAME AND METHOD OF MANUFACTURE THEREOF

BACKGROUND OF THE INVENTION

1. Field of the Invention

The present invention relates to screen door frames and window screen frames and a method of manufacturing such frames.

2. Description of the Prior Art

In conventional practice metal screen door frames and metal window screen frames are manufactured from strips of flat metal stock which are die cut to form angled miter corners and opposing flaps which are later adhesively secured at the corners of the frame. According to conventional practice a continuous flat sheet metal strip is advanced using a conveyor system beneath one or more dies mounted thereabove. The sheet metal strip is advanced a distance equal to the length of metal stock needed to form a jamb and an adjacent head or a sill of a single screen frame and then halted beneath the dies. The dies are thereupon actuated and are brought down onto the flat sheet metal strip to cut angled mitered corners and opposing flaps in longitudinal edges of the strip. The dies are then raised from the flat sheet metal strip out of contact therewith.

The flat sheet metal strip is then advanced another incremental length equal to the length necessary to form another of the jambs and a head or sill of the screen frame. The sheet metal strip is thereupon again halted and the die cutting operation is thereupon repeated. A conventional screen frame fabrication technique of this type is described in my prior U.S. Pat. No. 5,018,263.

In the prior die cutting or stamping technique described, the flat sheet metal strip used to form the screen frame is advanced in incremental steps and then halted so that it remains stationary beneath the cutting dies as the dies are actuated to strike the sheet metal strip and cut the necessary mitered corners and opposing flaps into the edges thereof. Because of the finite time that is required for the die blades to contact the surface of the metal strip, penetrate through the structure thereof, and withdraw from contact with the metal strip, it has heretofore been considered necessary to immobilize the sheet metal strip beneath the dies for the length of time that is required to advance and withdraw the dies through the structure of the sheet metal strip. Cyclical advancement and halting of the sheet metal strip has heretofore been required so that the dies cut cleanly and at precise intervals along the length of the strip. Utilizing this technique a throughput of approximately 900 one-piece screen door frames can be produced per working shift.

SUMMARY OF THE INVENTION

According to the present invention, an improved screen frame fabricating technique has been devised for fabricating a one-piece sheet metal screen door or window frame. Unlike conventional techniques, the manufacturing method of the invention allows the necessary openings to be die cut from a sheet metal strip without interrupting the movement of the sheet metal strip as it moves on a conveyor. Unlike prior systems, the sheet metal strip is fed continuously past the cutting dies without stopping or slowing down.

Continuous, uninterrupted movement of the sheet metal strip is made possible by mounting the cutting die or dies in such a manner that the cutting elements of the dies are advanced from a predetermined base position in the same direction and at the same speed as the moving sheet metal strip during the time that the dies are actuated to strike the flat sheet metal strip and thereby punch the requisite openings therein. Once the cutting elements of the die are withdrawn from contact with the sheet metal strip, each die is retracted in the direction opposite to the direction of travel of the conveyor and is returned to the predetermined base location of the die. Thus, each die follows and matches speed with the sheet metal strip during the cutting operation and is returned to its base position in between cuts.

The ability to feed the sheet metal strip continuously without the necessity for stopping it while the dies cut the necessary openings greatly increase the rate of production of screen frames. While about 900 frames of a one-piece screen door frame can be produced per shift according to the method of my prior U.S. Pat. No. 5,018,263, about 2,000 frames can be produced per shift according to the method of the present invention. Thus, the invention more than doubles the productivity of the production line.

The mechanism employed to move the cutting dies so as to match the speed of the traveling sheet metal strip is an accelerator. An accelerator employs a stationary component and a propulsion rod mounted for reciprocal movement in a direction parallel to the direction of conveyor travel. A propulsion rod is connected to each die to carry it in longitudinal reciprocation in the direction of conveyor movement. Each die is propelled at a speed that matches the speed of the conveyor. Each die is then returned in the opposite direction to a predetermined rest position against a stationary die component.

The propulsion rod is powered by electromagnetic, pneumatic, or hydraulic force. The extension of the propulsion rod to match the speed of the conveyor is coordinated under the control of a computer which receives an input from a measuring device that is fixed relative to the stationary component of the die. The measuring device measures the speed of travel of the flat sheet metal strip on the conveyor. The measuring device may employ a transducer that typically produces electronic signals and generates a predetermined number of electronic signals with each revolution of a roller that resides in rolling contact with the traveling sheet metal strip. The roller is turned in rotation by the sheet metal strip as the sheet metal strip is propelled by the conveyor.

The electronic signals produced from the transducer of the measuring device are added to the contents of an electronic signal count accumulation register. The computer compares the contents of the electronic signal count accumulation register with a predetermined electronically stored actuation initiation count. When the count stored in the electronic count accumulation register equals the predetermined electronically stored actuation initiation count, the computer produces an actuating signal that is transmitted to both the stationary and cutting components of each of the dies. The propulsion rod is thereupon thrust from the stationary component of each die in a direction parallel to and at a speed matched with the speed of the traveling sheet metal. Concurrently, the cutting element of each die is actuated to move perpendicular to the alignment of the propulsion rod and strike the traveling sheet metal strip and punch the requisite openings therein.

Since the cutting elements of the dies are carried at the same speed and in the same direction as the traveling sheet metal strip, the only relative movement between the cutting elements of the die and the sheet metal strip is motion normal to the plane of the sheet metal strip. This allows clean, precise cuts in the sheet metal strip at tightly controlled, predetermined locations thereon. With each actuation of the dies the computer resets the electronic signal count accumulation register.

In one broad aspect the present invention is an improved method of forming a hollow metal screen frame. The method of the invention is comprised of the steps of: cutting an elongated, continuous sheet metal strip; continuously feeding the flat sheet metal strip on a conveyor moving continuously at a predetermined speed while providing support to the flat strip from beneath; mounting a cutting die at a predetermined location above the conveyor, the cutting die being operable for actuation to strike the flat sheet metal strip and thereby punch openings therein, and for deactuation to withdraw the die from contact with the metal strip; actuating the cutting dies while concurrently advancing the cutting die from the predetermined position in the same direction and at the same speed as the conveyor; and deactuating the cutting die while concurrently retracting it to the predetermined location.

Other advantageous techniques have also been devised to improve the quality of the screen frame produced. In my prior U.S. Pat. No. 5,018,263 the openings cut in the longitudinal edges of the strip included angled miter corners and opposing flaps. Once the strip was cut into sections, a two-part epoxy adhesive was applied at specific locations on the corners and opposing flaps. That is, a spot of epoxy adhesive was applied on one of the opposing members while a spot of epoxy activator was applied to the corresponding opposing element. Once the section of the flat strip was rolled to form a frame of generally rectangular cross section and bent at the corners, the flaps of one side of the frame were forced into the embrace of the mitered ends of an adjacent side. This brought the activation into contact with the adhesive to thereby create an adhesive bond on each side of each corner of the screen frame.

However, once the screen frame was in use and subjected to twisting and other various stresses which sometimes occur, there were instances of failure of the adhesive bond. When this occurs the screen frame no longer holds a true rectangular shape. Rather, the corners can move so that the frame becomes distorted in configuration and changes from a true rectangular shape to the shape of a parallelogram.

The manufacturing method of the invention employs a technique that greatly reduces the tendency for this problem to occur. Specifically, the sheet metal strip used to form a screen frame is die cut to provide enclosed openings located interiorly of the lateral edges of the strip and with locking tabs extending longitudinally from the flaps formed at the mitered corners.

Once the screen frame has been rolled into screen stock having a substantially rectangular cross section, the locking tabs project in alignment with the corresponding locking tab openings. When a section of the screen frame stock is then bent at right angles at each of its corners to form a pair of mutually parallel jambs and a pair of members perpendicular thereto, including mutually parallel head and sill members both oriented perpendicular to the jambs, the locking tabs project through the locking tab openings. The extremities of the locking tabs that project through the locking tab openings are thereupon bent over so that they cannot be withdrawn from the locking tab openings. By forming each of the corners in this manner, the jambs are held in perpendicular orientation relative to the head and sill not only by adhesive bonds therebetween, but also by the mechanically interlocking tabs that are engaged in corresponding locking tab openings.

In another broad aspect the invention may be considered to be a method of forming a hollow metal screen frame comprising the steps of: cutting an elongated, continuous, flat sheet metal strip; cutting mitered corners, and opposing flaps with projecting locking tabs thereon in longitudinal edges of said strip, and cutting locking tab openings in the interior of said strip; cutting said strip transversely into separate sections each of a length equal to the perimeter of a single frame; rolling each of said sections laterally to form an essentially rectangular frame stock; crimping free longitudinal edges of the strip together between the mitered corners to form alternating jamb and head and sill members; longitudinally bending the sections at right angles between the adjacent members thereof to bring the jamb members into perpendicular alignment relative to the head member and the sill member so that the extremities of the locking tabs project through said locking tab openings; and bending the extremities of said locking tabs laterally to thereby secure the jamb members in perpendicular alignment relative to said head and sill members.

Preferably each section of the metal strip is formed with a concave, outwardly facing channel so that the locking tab openings at each of the mitered corners reside on opposite sides of the channel. Thus, when the extremities of the locking tabs are bent, they are bent into the channel from opposite sides thereof.

This operation is preferably performed by placing each section of the strip that has been bent to form jambs and a head and a sill between opposing pairs of forming dies. The forming dies within each pair of forming dies are mounted for movement toward each other and in alignment with one of the members. Preferably, the locking tab openings are formed in the jambs and the locking tabs are formed on the head and on the sill and project into the corresponding interiorly located openings in the jambs from flaps formed on the head and sill members. The forming dies within each pair of forming dies are mounted for movement toward each other and in alignment with one of the members. Since the locking tab openings are normally formed in the jamb members, the pairs of forming dies are mounted in alignment with the head and sill members. The forming dies are then actuated in unison so that the dies within each pair are forced toward each other to thereby contact and bend the extremities of the locking tabs into the channels from opposite sides thereof.

Once the extremities of the locking tabs have been bent over into the channels they cannot be withdrawn back through the locking tab openings. Furthermore, since there is a locking tab engaged in a locking tab opening at each corner of the frame, and since the forming dies serve not only to bend the locking tabs over but also to ensure that the four corners of the frame are formed at right angles, a screen frame is produced in which the right angle corners are mechanically joined together as well as bonded by adhesive.

In still another aspect the invention may be considered to be an improvement in a screen frame having a pair of mutually parallel jamb members and a pair of mutually parallel members including a head and a sill that are oriented perpendicular to the jamb members. According to the improvement the members in one of the pairs of members are provided with locking tabs and the members in the other of the pairs of members are provided with locking tab openings therein. The extremities of the locking tabs project through the locking tab openings and are inelastically formed therebeyond to prevent their withdrawl therefrom.

The invention may be described with greater clarity and particularity by reference to the accompanying drawings.

DESCRIPTION OF THE EMBODIMENT AND IMPLEMENTATION OF THE METHOD

Figure 1:
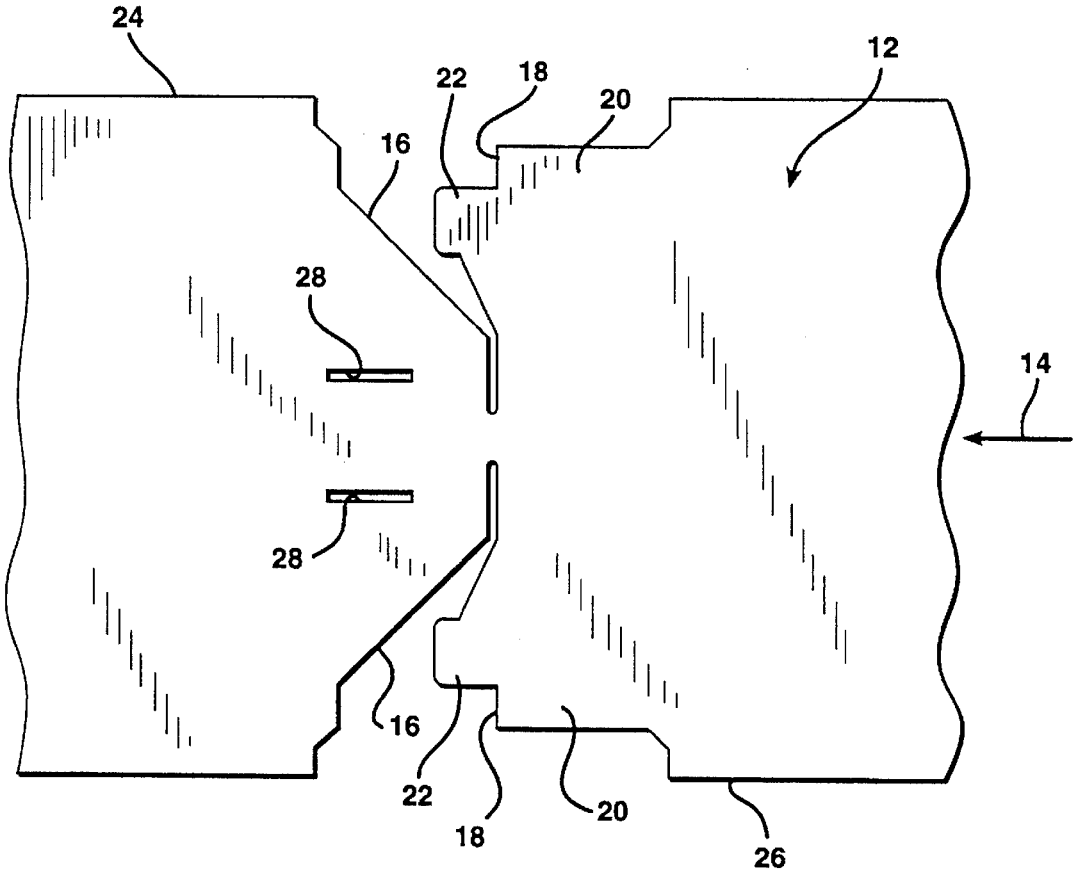
FIG. 1 is a plan detail of a portion of a flat sheet metal strip used to form a screen frame according to the invention and showing a set of die cut openings therein.

FIG. 1 illustrates in plan view a portion of an elongated, continuous, flat sheet metal strip 12 used in the fabrication of a metal screen frame. The flat sheet metal strip 12 is shown in FIG. 1 at a point along its length at which a corner of the frame is to be formed and after being die cut in preparation for forming of the corner. The sheet metal strip 12 is die cut while moving in a linear direction at constant speed in a direction indicated by the directional arrow 14.

The sheet metal strip 12 is shown with a pair of angled cuts 16 oriented at forty-five degrees relative to the direction of strip movement 14. The angled cuts 16 produce a miter portion in both of the longitudinal edges 24 and 26 of the metal strip 12. With the same die cutting action cuts 18 are produced in the edges 24 and 26 to define flaps 20 which will be tucked under the miter cuts 16 in succeeding steps. Also, the same die cutting operation produces locking tabs 22 that project longitudinally from the flaps 20 in the direction 14. The foregoing cuts are formed in mirror image on each side of the lateral center of the flat strip 12 in the lateral edges 24 and 26 thereof.

In addition, the same die cutting operation produces longitudinally aligned, elongated locking tab openings 28 in the interior of the strip 12. The locking tab openings 28 are disposed on opposite sides of the lateral center of the sheet metal strip 12 that lies midway between the edges 24 and 26. The locking tab openings 28 are oriented parallel to the direction of movement 14 of the sheet metal strip 12. The locking tab openings 28 are long enough to accommodate the widths of the locking tabs 22.

Figure 2:
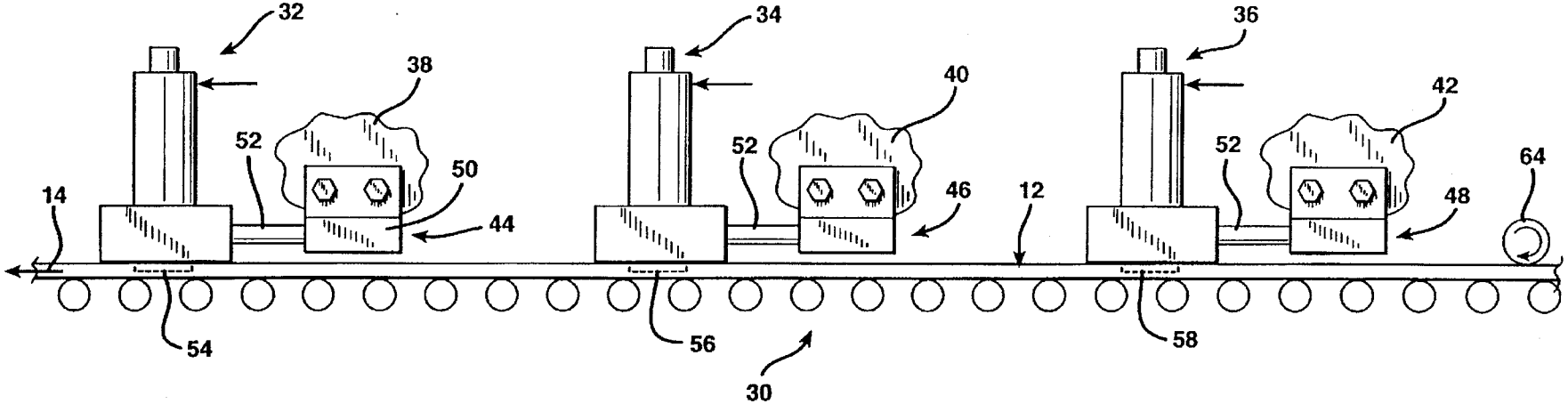
FIG. 2 is a diagrammatic elevational view showing actuation of the die members that are used to form openings of the type depicted in FIG. 1.
Figure 3:
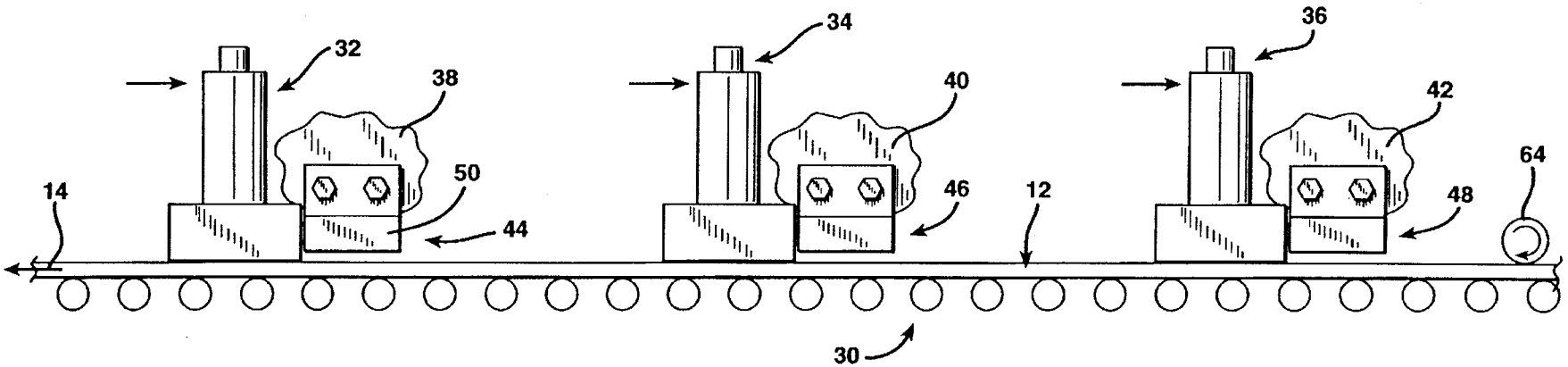
FIG. 3 is a diagrammatic elevational view illustrating the deactuation and retraction of the die members of FIG. 2 between successive actuations thereof.

According to the invention a hollow, metal screen frame is formed using many of the steps described in my prior U.S. Pat. No. 5,018,263, but with very significant differences as described herein. FIGS. 2 and 3 illustrate the sheet metal strip 12 as it is propelled in the direction 14 by a multiplicity of powered conveyor rollers indicated collectively at 30. The conveyor rollers 30 not only propel the sheet metal strip 12 in the direction 14, but also provide support to the sheet metal strip 12 from beneath.

Separate cutting dies 32, 34, and 36 are mounted at predetermined fixed locations 38, 40, and 42 above the conveyor 30. The locations 38 and 42 are spaced apart a distance corresponding to the length of the longest sides of a screen frame, which are typically the upright jamb members. The location 40 is at a position between the locations 38 and 42 that corresponds to the position of a latch and handle assembly on a screen door jamb.

Each of the dies 32, 34, and 36 has associated therewith an accelerator 44, 46, and 48, respectively. Each of the accelerators 44, 46, and 48 includes a stationary member 50 and a die propulsion rod 52 extending longitudinally from the stationary member 50 above the conveyor 30 and oriented parallel to the direction of travel 14 of the flat sheet metal strip 12.

The dies 32, 34, and 36 are mounted on the free extremities of the propulsion rods 52 of the accelerators 44, 46, and 48, respectively, as shown in FIG. 2. The dies 32, 34, and 36 include solenoid actuated cutting elements indicated in phantom at 54, 56, and 58, respectively. The cutting dies 32, 34, and 36 are operable for actuation to move the cutting elements 54, 56, and 58 perpendicular to the direction of strip travel 14 and through the thickness of the sheet metal strip 12. When the cutting dies 32, 34, and 36 are actuated, the cutting elements 54, 56, and 58 strike the flat sheet metal strip 12 and thereby punch openings therein.

The cutting die 32 punches the openings depicted in FIG. 1, while the cutting die 36 punches openings having a mirror image configuration to the openings depicted in FIG. 1. The cutting die 34 is only actuated with every other cycle of actuation of the dies 32 and 36 and punches appropriate openings to accommodate a screen door handle. The die 34 is not actuated at all in forming screen frames for window screens.

When the cutting dies 32, 34, and 36 are deactuated, the cutting elements 54, 56, and 58 thereof are withdrawn vertically upwardly and out of contact with the sheet metal strip 12. Concurrently, the propulsion rods 52 are retracted into the stationary portions 50 of the actuators 44, 46, and 48, thereby longitudinally retracting the dies 32, 34, and 36 from a condition of travel in which their speed in the direction 14 matches that of the sheet metal strip 12 to a stationary condition. In the stationary condition the cutting dies 32, 34, and 36 reside at the locations 38, 40, and 42, respectively, while the sheet metal strip 12 continues to pass therebeneath on the conveyor system 30, as illustrated in FIG. 3.

Figure 4:
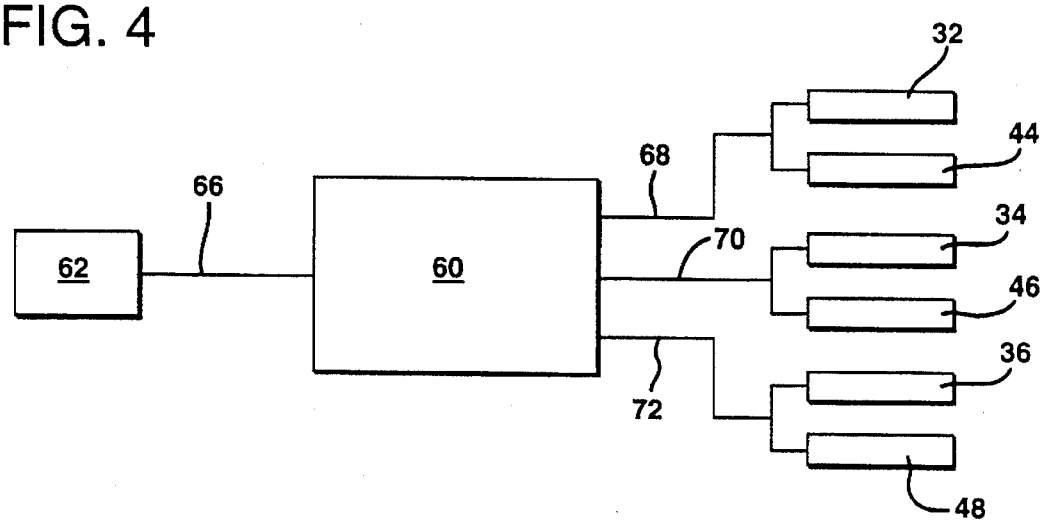
FIG. 4 is a block diagram illustrating the computer control of synchronization of travel of the sheet metal strip of FIG. 1 and actuation and deactuation of the dies shown in FIGS. 2 and 3.

The actuation and deactuation of the cutting dies 32, 34, and 36 is coordinated under the control of a computer 60, depicted diagrammatically in FIG. 4. To enable coordination a measuring device 62 is provided and is coupled to the computer 60. The measuring device 62 includes a roller 64, depicted diagrammatically in FIGS. 2 and 3. The roller 64 is rotated in a clockwise direction by the passage of the flat metal strip 12 in the direction 14. In addition to the roller 64, the measuring device 62 includes a transducer that produces electronic signals. The transducer in the measuring device 62 generates a predetermined number of electronic signals with each revolution of the roller 64. The electronic signals produced by the transducer are transmitted to the computer 60 over an electrical connection 66.

The computer 60 includes an electronic signal count accumulation register. The electronic signals received on connector 66 from the transducer in the measuring device 62 are added to the contents of the electronic signal count accumulation register in the computer 60. The computer 60 compares the contents of the electronic count accumulation register with a predetermined electronically stored actuation initiation count, also stored in the computer 60. When the accumulated count of the electronic signals from the transducer in the measuring device 62 equals the actuation initiation count, the computer 60 transmits actuating signals to the accelerators 44, 46, and 48 and also to the cutting dies 32, 34, and 36.

The computer 60 also concurrently resets the count accumulation register. The computer 60 sends actuating signals to the cutting die 32 and its associated accelerator 44 on line 68. Actuating signals are sent concurrently to the cutting die 34 and its associated accelerator 46 on line 70. The computer sends actuating signals on line 72 to the cutting die 36 and its associated accelerator 48. Actuating signals are sent on lines 68 and 72 concurrently each time the count in the electronic signal count accumulation register reaches a predetermined, electronically stored actuation initiation count corresponding to the length of a head and sill member in a screen frame. An actuating signal is generated on line 70 only every other cycle, and only while producing frames for screen doors since a handle is formed only in one jamb of a screen door frame.

Upon receipt of an actuating signal the accelerators 44, 46, and 48 thrust their propulsion rod 52 horizontally to the left from the retracted positions depicted in FIG. 3 as shown in FIG. 2. The propulsion rods 52 travel in the same direction 14 that the sheet metal strip 12 travels, and at the same speed. As a consequence, when each of the cutting dies 32, 34, and 36 has been actuated simultaneously with its corresponding accelerator 44, 46, and 48, the actuated cutting dies remain above a particular spot on the moving flat sheet metal strip 12, since the actuated cutting dies are carried in the same direction and at the same speed as the sheet metal strip 12 by the propulsion rods 52.

During the extension of the propulsion rods 52 from the stationary portions 50 of the accelerators, the cutting elements 54, 56, and 58 of the cutting dies 32, 34, and 36 strike the location on the traveling sheet metal strip 12 above which their respective cutting dies are located, sever material therefrom, and withdraw from contact with the sheet metal strip 12 prior to the time that the propulsion rods 52 have been fully extended. By the time the propulsion rods 52 reach their fully extended positions, the cutting elements 54, 56, and 58 have been withdrawn from contact with the sheet metal strip 12. At this point in time the cutting dies 32, 34, and 36 no longer travel with the sheet metal strip 12, but instead are deactuated, as are the accelerators 44, 46, and 48. With each deactuation the propulsion rods 52 are retracted from their extended positions depicted in FIG. 2 back to their retracted positions depicted in FIG. 3, thus returning the cutting dies 32, 34, and 36 to the predetermined, fixed locations 38, 40, and 42, respectively.

It can thus be seen that unlike prior art screen frame fabricating methods, the method of the present invention provides for continuously feeding the flat sheet metal strip 12 on the conveyor system 30. The sheet metal strip 12 moves continuously at a predetermined speed, typically about 120 linear feet per minute, and is not halted in its movement for cutting of openings by the dies 32, 34, and 36.

The cutting dies 32 and 36 cut the mitered corners 16 of opposing flaps 18 and projecting locking tabs 22 on the flaps 20 in the longitudinal edges 24 and 26 of the strip 12. The cutting dies 32 and 36 also cut the locking tab openings 28 in the interior of the sheet metal strip 12, also as depicted in FIG. 1.

The strip 12 is then cut transversely into separate sections of uniform length under the control of an electric eye in a conventional manner. Each of these separate sections is of a length equal to the perimeter of a screen frame. Each of these sections is then rolled laterally in the manner described in my prior U.S. Pat. No. 5,018,263 to form an essentially rectangular frame stock. The longitudinal edges 24 and 26 of the strip 12 of each section are then crimped together between the mitered corners illustrated in FIG. 1 to form jamb members 80 and 82, a head member 84, and a sill member 86 which are shown at a later stage in fabrication in FIG. 8. The steps in cutting the sheet metal strip 12 into separate sections, rolling each of the sections to form an essentially rectangular frame stock, and crimping the longitudinal edges 24 and 26 of the strip 12 together are conventional and are as described in my prior U.S. Pat. No. 5,018,263.

Figure 5:
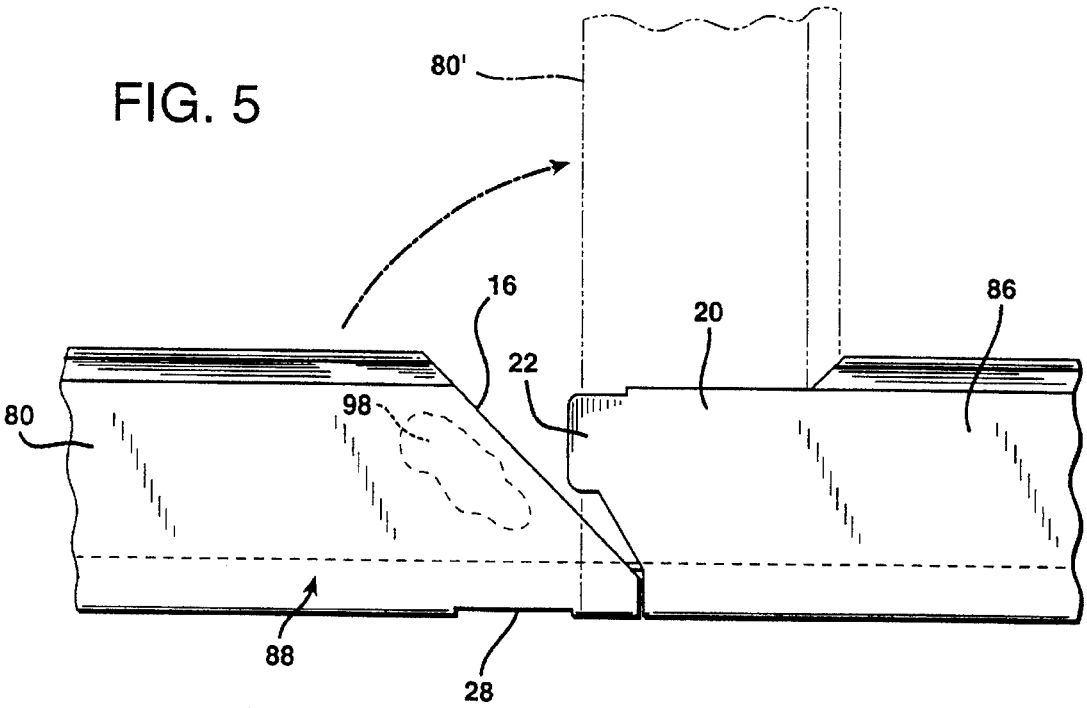
FIG. 5 is a elevational detail showing a section of the sheet metal strip of FIG. 1 rolled to form a rectangular frame section and being bent to form a corner therein.
Figure 6:
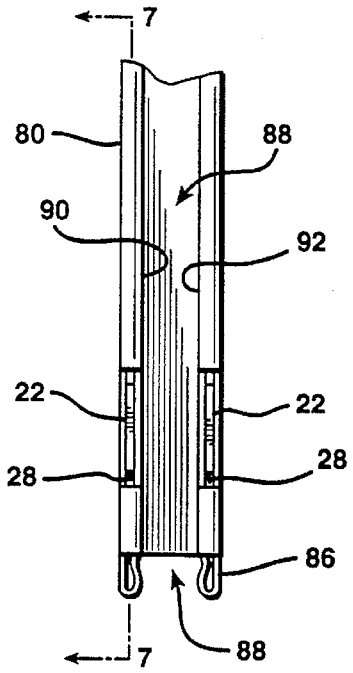
FIG. 6 is an end view showing a corner between two frame members once the frame members have been bent at right angles relative to each other as shown in phantom in FIG. 5 and in FIG. 7.
Figure 11:
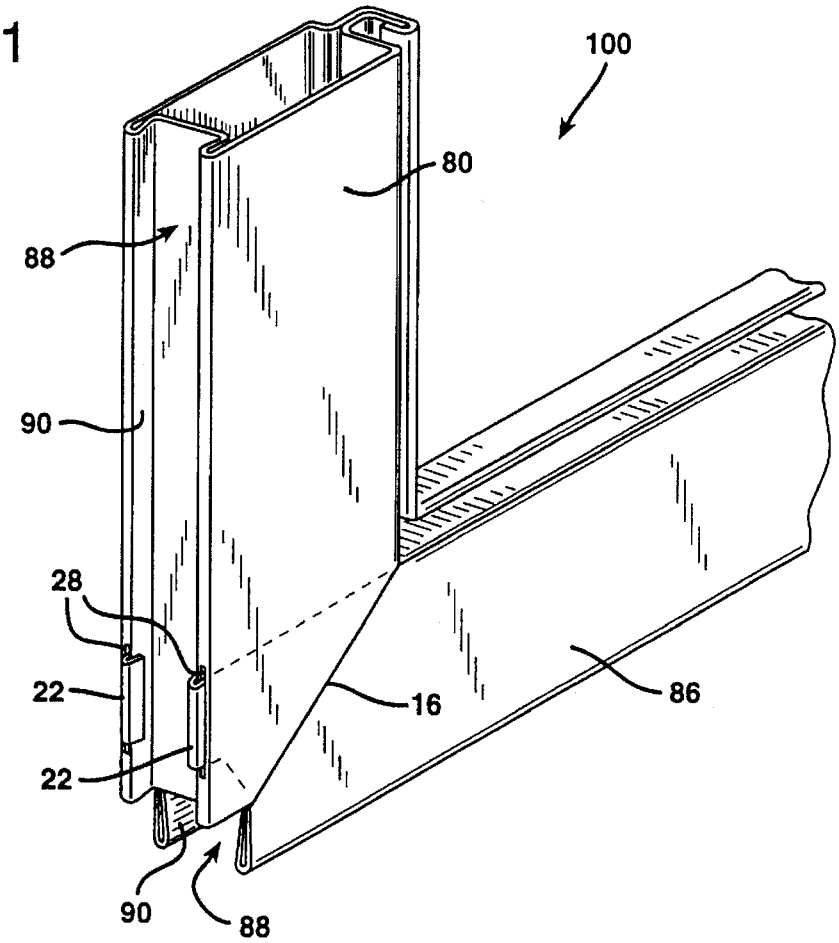
FIG. 11 is a perspective view illustrating a corner of a screen frame formed according to the invention.

Once the strip 12 of each frame section has been rolled and crimped, the frame stock appears substantially as depicted in FIG. 5. During the rolling process central channels 88, best depicted in FIGS. 6 and 11, are formed into each of the sections of the strip 12. The channels 88 have a U-shaped cross section as illustrated. Each of the channels 88 is disposed to face concave outwardly. The locking tab openings 28 are positioned in pairs that straddle the center line of the sheet metal strip 12 at a distance such that when the sheet metal strip 12 is rolled to form the substantially rectangular stock with the outwardly facing channels 88 defined therein, the locking tab openings 28 reside at the tops of the interior walls 90 and 92 forming the sides of the outwardly facing channels 88.

At this stage in the fabrication the jamb members 80 and 82, the head member 84, and the sill member 86 of each frame are still longitudinally aligned with each other in the manner depicted in solid lines in FIG. 5. As is evident the flaps 20 are still exposed and the locking tabs 22 on the head member 84 and sill member 86, extend longitudinally toward the jamb members 80 and 82.

At this point in the fabrication a spot 98 of a single component adhesive, for example cyanoacrylate, is applied to the inwardly facing surface of each side of the frame stock immediately adjacent to the miter cuts 16 thereon as illustrated in FIG. 5. The frame sections are then bent at right angles between each of the members 80, 84, 82, and 86 to bring the jamb members 80 and 82 into perpendicular alignment relative to the head member 84 and sill member 86, as illustrated in phantom at 80' in FIG. 5. As the members are bent at right angles, the flaps 20 pass inwardly of the mitered walls of the jamb members 80 and 82 in sliding contact therewith. This movement smears the adhesive spot 98 which quickly dries to establish a firm, adhesive bond between the outwardly facing surfaces of the flaps 20 and the corresponding inwardly facing surfaces of the jambs 80 and 82 at the corners thereof.

Figure 7:
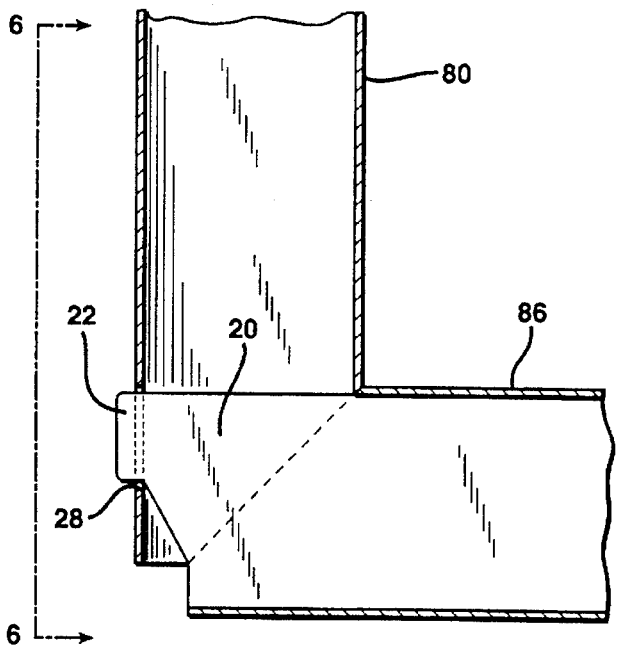
FIG. 7 is a sectional elevational detail taken along the lines 7—7 of FIG. 6.

Also, as each metal frame section is bent at the corners defined therein to form the right angle configurations depicted for example at 80' in FIG. 5, the locking tabs 22, still longitudinally extended, pass through the locking tab openings 28. The extremities of the locking tabs 22 protrude from the structures of the jambs 80 and 82 through the locking tab openings 28 in the manner depicted in FIGS. 6 and 7.

Figure 8:
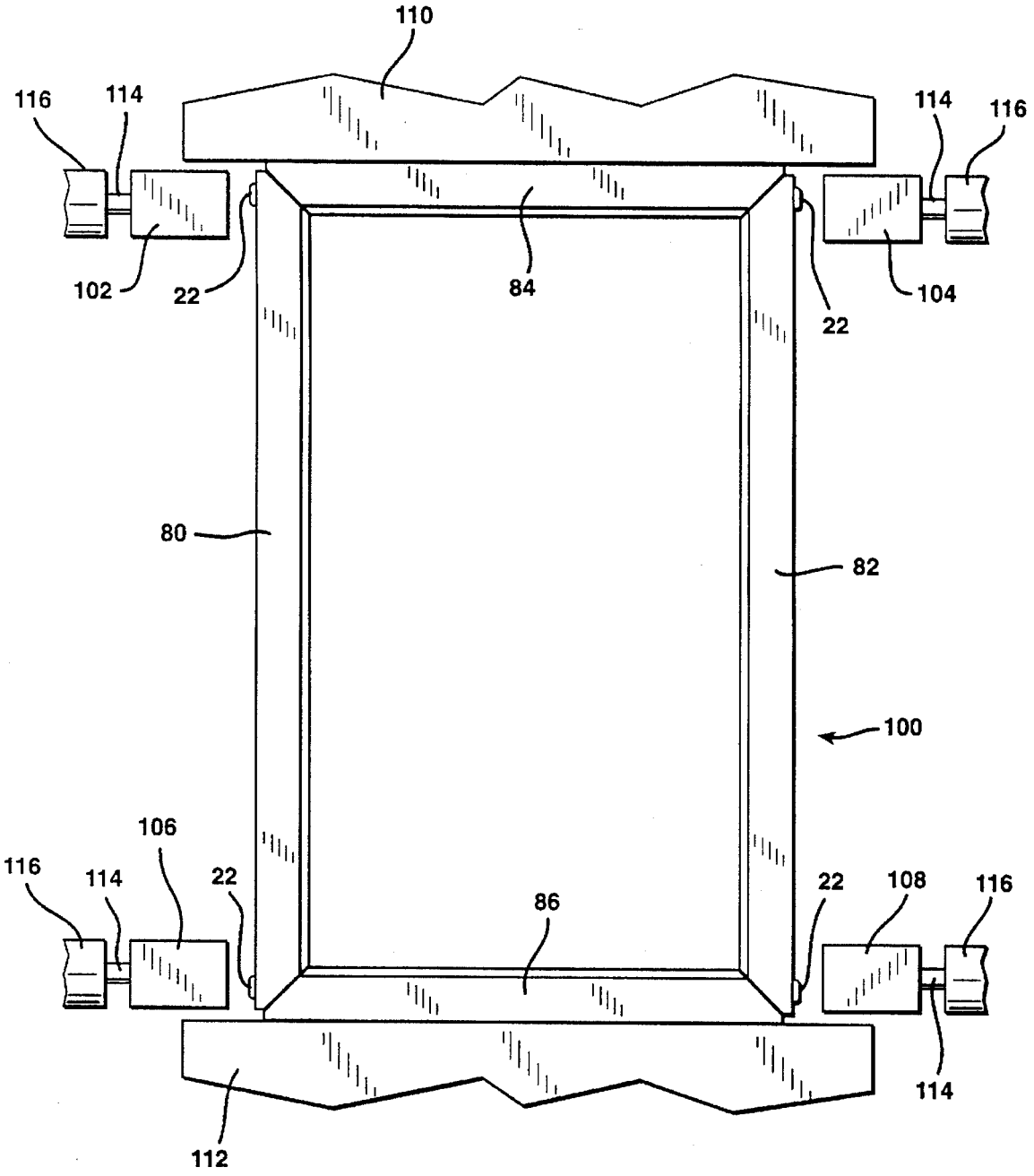
FIG. 8 is a plan view illustrating a frame section bent to form jamb members and head and sill members and placed between opposing pairs of forming dies prior to actuation of the forming dies.

Each section of the rectangular sheet metal stock is thereby formed into a rectangular frame 100. The frame 100 is then placed between opposing pairs of forming dies as illustrated in FIG. 8. The dies 102 and 104 are arranged in a first pair of forming dies, while the forming dies 106 and 108 constitute a second pair of forming dies. The forming dies within each pair are mounted for movement toward each other and in alignment with one of the frame members. That is, the forming dies 102 and 104 in the first pair are linearly aligned with each other and with the head member 84 and are movable toward each other. Likewise, the forming dies 106 and 108 in the second forming die pair are linearly aligned with each other and with the sill member 86. The path along which the first pair of dies 102 and 104 move is parallel to the path along which the dies 106 and 108 in the second pair of forming dies travel. The frame 100 fits snugly between two immovable, lateral supports 110 and 112.

Figure 10:
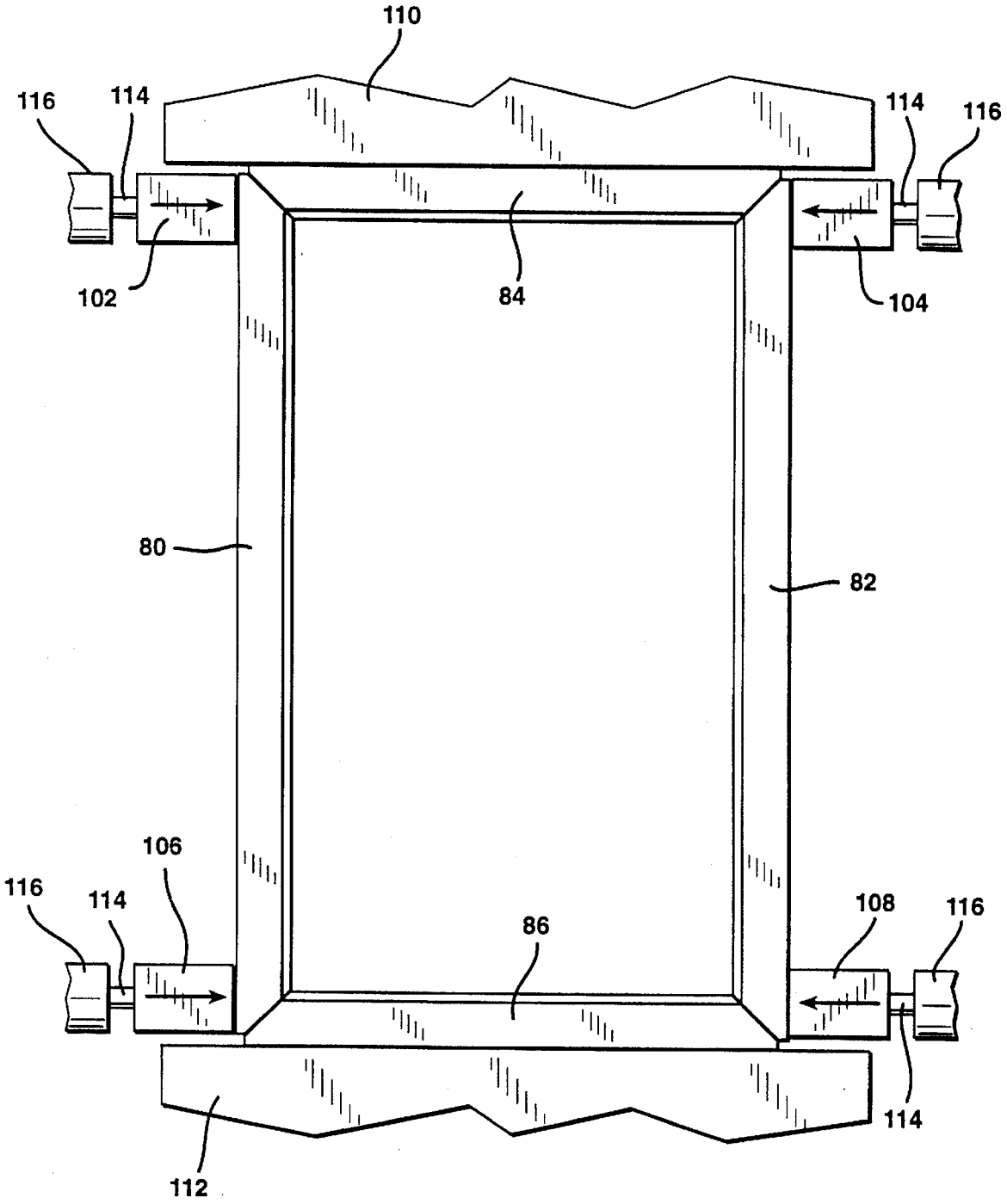
FIG. 10 is a plan view of the frame shown in FIG. 8 illustrating the forming dies as they are actuated.

The forming dies 102, 104, 106, and 108 are then simultaneously actuated with the forming dies within each pair being thrust toward each other as depicted in FIG. 10. The dies 102, 104, 106, and 108 are mounted at the ends of pistons 114 that move within hydraulic actuation cylinders 116.

Figure 9:
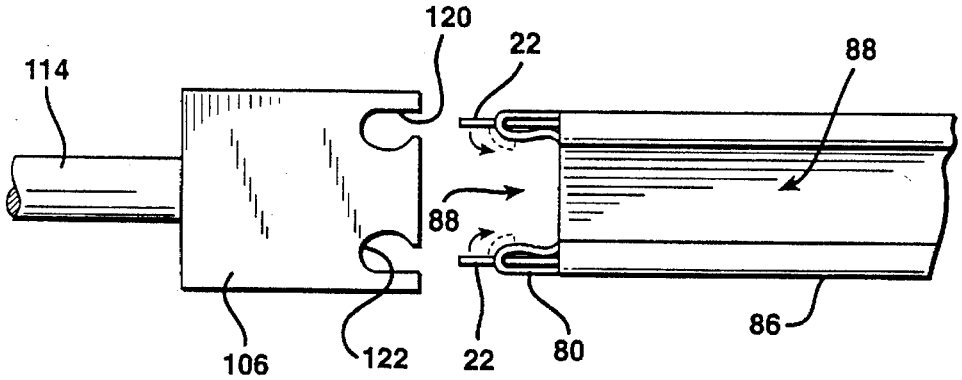
FIG. 9 is a side elevational detail showing a single one of the forming dies and a corner of the frame shown in FIG. 8.

Each of the forming dies 102, 104, 106, and 108 is configured with a pair of concave cavities 120 and 122 defined therein as, illustrated in the detailed view of the die 106 shown in FIG. 9. All of the forming dies 102, 104, 106, and 108 are of identical configuration. As the dies are thrust toward each other and toward the jambs 80 and 82 which they respectively face, the extremities of the locking tabs 22 enter into the cavities 120 and 122 and follow the curvature thereof and are inelastically deformed to prevent their withdrawal from the locking tab openings 28. The extremities of the locking tabs 22 are all bent inwardly and back down into the channels 88 in tight locking contact engagement with the facing channel wall surfaces 90 and 92 in the manner indicated in FIG. 9.

Once the extremities of the locking tabs 22 have been folded over the structure of the frame forming the walls 90 and 92 of the channels 88, the forming dies 102, 104, 106, and 108 are then withdrawn from contact with the frame 100 from the position shown in FIG. 10 back to the retracted position shown in FIG. 8. At this point all of the locking tabs 22 are bent over into contact with the corresponding interior wall surfaces 90 and 92 of the channels 88 in the manner depicted in FIG. 11.

As shown in FIG. 11, and with reference as well to FIG. 10, the finished screen frame 100 has a pair of mutually parallel jamb members 80 and 82 and a pair of mutually parallel transverse members, namely the head and sill members, respectively indicated at 84 and 86. The head member 84 and the sill member 86 are oriented perpendicular to the jamb members 80 and 82.

As shown in FIG. 11, the locking tabs 22 provided on the head and sill members 84 and 86 project through the locking tab openings 28 that are provided in the jamb members 80 and 82 near the corners thereof. The extremities of the locking tabs 22 are inelastically deformed into the channels 88 to prevent their withdrawal from the locking tab openings 28.

A screen frame 100 formed in accordance with the invention therefore has enhanced rigidity compared to prior devices. The corners are held in right angle alignment not only by adhesive bonds established by the spots of adhesive 98, but also by the interlocking engagement of the locking tabs 22 with the adjacent frame members through the locking tab openings 28 defined therein.

The manufacturing technique of the invention not only provides a metal screen frame which can be manufactured at a far greater production rate than has heretofore been possible, but also provides a finished product which is more rigid than those previously produced.

Undoubtedly, numerous variations and modifications of the invention will become readily apparent to those familiar with screen frame construction. For example, optical sensors or timing mechanisms could be employed in place of the measuring device 62 described with reference to FIG. 4. Other modifications of the invention are also possible without departing from the scope thereof. Accordingly, the invention should not be construed as limited to the specific implementation of the method described and embodiment of the screen frame produced as illustrated.

I claim:

1. A method of forming a hollow metal screen frame comprising the steps of:

(a) cutting an elongated, flat sheet metal strip;

(b) continuously feeding said flat sheet metal strip on a conveyor moving continuously at a predetermined speed and in a predetermined direction while providing support to said flat sheet metal strip from beneath;

(c) mounting a cutting die at a predetermined location above said conveyor, said cutting die being operable for actuation to strike said flat sheet metal strip and thereby punch openings therein, and for deactuation to withdrawl said cutting die from contact with said metal strip;

(d) actuating said cutting die while concurrently advancing said cutting die from said predetermined location in said predetermined direction and at said predetermined speed;

(e) deactuating said cutting die while concurrently retracting it to said predetermined location;

(f) cutting said strip into separate sections, each section being of a length equal to the perimeter of a single frame;

(g) rolling each of said sections to form an essentially rectangular frame stock;

(h) crimping said longitudinal edges of each section together between said openings to from a pair of jamb members and a pair of members transverse thereto including a head member and a sill member in which said members of each pair alternate with the members of each other pair;

(i) longitudinally bending each section at said openings therein to bring said jamb members into perpendicular alignment relative to said head and sill members to form corners; and (j) joining each member of a section to each adjacent member thereof at all of said corners.

2. A method according to claim 1 wherein said openings include edge openings in longitudinal edges of said strip that define mitered corners and longitudinally projecting flaps with locking tabs projecting longitudinally therefrom and enclosed locking tab openings defined interiorally of said longitudinal edges of said strip proximate said edge openings therein so that the extremities of said locking tabs project through said locking tab openings when each section is bent as aforesaid, and further comprising inelastically deforming said extremities of such locking tabs beyond said locking tab openings to thereby prevent the withdrawl of said locking tabs from said locking tab openings.

3. A method according to claim 2 further comprising forming central channels into each of sections during said step of rolling wherein said locking tab openings lie adjacent said channels, and bending each section such that said channels are disposed concave outwardly, and inelastically deforming said extremities of said locking tabs so that said locking tab extremities are bent into said channels.

4. A method according to claim 3 wherein said locking tabs are defined on said head and sill members and said locking tab openings are defined in said jamb members.

5. A method according to claim 1 further comprising measuring the passage of predetermined lengths of said flat metal strip past a measuring device that is fixed relative to said predetermined location at which said die is mounted, and actuating said die with a passage of each of said predetermined lengths past said measuring device.

6. A method according to claim 5 further characterized in that said measuring device includes a roller that is rotated by passage of said flat metal strip and a transducer operated by said roller to produce a predetermined member of electronic signals with each revolution of said roller, and further comprising adding said electronic signals from said transducer to the contents of an electronic signal count accumulation register, comparing the contents of said electronic signal count accumulation register with a predetermined electronically stored actuation initiation count and actuating said die and resetting said electronic signal count accumulation register when the accumulated count of said electronic signals from said transducer equals said actuation initiation count.

7. A method according to claim 1 further comprising periodically applying adhesive to said method in at least one of said pairs of members such that said corners are joined by said adhesive when said jamb members are brought into alignment relative to said head and sill members.

8. A method of forming a hollow metal screen frame comprising the steps of:

(a) cutting an elongated continuous flat sheet metal strip;

(b) cutting mitered corners and opposing flaps with projecting locking tabs having projecting extremities thereon in longitudinal edges of said strip and cutting locking tab openings in the interior of said strip;

(c) cutting said strip into separate sections each of a length equal to the perimeter of a single frame, (d) rolling each of said sections to form an essentially rectangular frame stock;

(e) crimping longitudinal edges of said strip together between said mitered corners to form jamb members and head and sill members;

(f) longitudinally bending said sections at right angles between said members to bring said jamb members into perpendicular alignment relative to said head and sill members and so that the projecting extremities of said locking tabs extend through said locking tab openings; and (g) bending said projecting extremities of said locking tabs laterally to thereby secure said jamb members in perpendicular alignment relative to said head and sill members.

9. A method according to claim 8 further comprising forming a concave outwardly facing channel into said sections of said metal strip during said step of rolling, wherein said locking tab openings at each of said mitered corners reside on opposite side of said channel, and further comprising bending said extremities of said locking tabs into said channel from opposite sides thereof during said step of bending said extremities of said locking tabs.

10. A method according to claim 9 further comprising periodically applying adhesive to said sheet metal strip between the lateral edges of said strip and each of said locking tab openings during rolling of said sections, whereby said flaps are brought into contact with said adhesive before it cures as said sections are longitudinally bent.

11. A method according to claim 9 further comprising placing sections that are bent to form jamb members and head and sill members between opposing pairs of forming dies in which said forming dies within each pair of forming dies are mounted for movement toward each other and in alignment with one of said members and said pairs of forming dies move along parallel paths, and forcing said forming dies within each pair toward each other to thereby contact and bend said extremities of said locking tabs as aforesaid.

12. A method according to claim 9 further comprising: continuously advancing said flat sheet metal strip past a die mounting station, while providing support to said flat metal strip from beneath; mounting a cutting die for longitudinally reciprocal movement at said die mounting station, said cutting die being operable for actuation to move in a direction transverse to said sheet metal strip to strike said flat sheet metal strip and thereby punch said mitered corners and opposing flaps with projecting locking tabs thereon and locking tab openings therein and for deactuation to withdraw said die from contact with said sheet metal strip; actuating said cutting die while concurrently advancing said cutting die from said die mounting station in the same direction and at the same speed as said flat sheet metal strip, and deactuating said cutting die while concurrently retracting it to said die mounting station.

13. A method according to claim 12 further comprising mounting and employing a plurality of dies as aforesaid which together cut said mitered corners and opposing flaps with projecting locking tabs and locking tab openings for each of said sections of said strip concurrently, and actuating and advancing said cutting die with the passage of a length of said metal strip equal to said length of said sections past said die mounting stations.

* * * * *